United States Patent [19]

Goddard

[11] 4,002,681

[45] Jan. 11, 1977

[54] BIS-GUANIDINIUM DECAHYDRODECABORATE AND A PROCESS FOR ITS PREPARATION

[75] Inventor: Terrence P. Goddard, Aptos, Calif.

[73] Assignee: Teledyne McCormick Selph, an operating division of Teledyne Industries, Inc., Hollister, Calif.

[22] Filed: June 10, 1976

[21] Appl. No.: 694,627

[52] U.S. Cl. ..... 260/564 D; 149/18

[51] Int. Cl.[2] ..... C07C 129/00

[58] Field of Search ..... 260/564 D

[56] References Cited

OTHER PUBLICATIONS

Chemical Abstracts, vol. 42, column 7498(a) (1948).

*Primary Examiner*—Gerald A. Schwartz

*Attorney, Agent, or Firm*—David H. Semmes; Warren E. Olsen

[57] ABSTRACT

This invention relates to a novel boron-containing salt. Specifically, the guanidinium salt of decahydrodecaboric acid, and a process for preparing same.

1 Claim, No Drawings

BIS-GUANIDINIUM DECAHYDRODECABORATE AND A PROCESS FOR ITS PREPARATION

BACKGROUND AND BRIEF DESCRIPTION OF THE INVENTION

Boron hydride salts, in particular the nonmetal salts of decahydrodecarboric acid, have been discovered to have particular utility in the field of high energy fuels. They may be used as constitutents of pyrotechnic compositions, and in rocket propellants. The present invention teaches a new nonmetal salt of decahydrodecaboric acid, which exhibits stable physical properties and exhibits several unusual pyrotechnic properties, in that the material deflagrates at a very rapid rate without the deflagration becoming a detonation.

A particular objective in preparing compounds suitable for certain types of pyrotechnic usage is to achieve a high gas output and low molecular weight combustion products, when the fuel is burned with a suitable oxidizing agent. Combustion products such as hydrogen ($H_2$) and nitrogen ($N_2$) gas fulfill this requirement. In preparing salts useful as pyrotechnic fuels from an anion such as decahydrodecaborate (-2) ($B_{10}H_{10}^{-2}$), it is therefore advantageous to use a cation containing a high weight fraction of atomic nitrogen and hydrogen. The guanidinium ion, chemical formula $C(NH_2)_3^{+1}$ has been found to be such a cation. In addition, the corresponding Bronsted base of the ion, free guanidine, is a strong base, which imparts to the cation, and thus the salt, a high degree of chemical stability.

DETAILED DESCRIPTION OF INVENTION the guanidinium salt of the decahydrodecaborate (-2) ion is represented by the chemical formula $(C(NH_2)_3)_2B_{10}H_{10}$. The salt is prepared by reacting one mole of guanidine carbonate, $(C(NH_2)_3)_2CO_3$, with one mole decahydrodecaboric acid, $H_2B_{10}H_{10}$, (or, as the hydronium form) $(H_3O^+)_2B_{10}H_{10}^{-2}$), in aqueous solution, $$2C(NH_2)_3^+{}_{(aq)} + CO_3^{-2}{}_{(aq)} + 2H^+{}_{(aq)} + B_{10}H_{10}^{-2}{}_{(aq)} \rightarrow H_2O + CO_2 + 2C(NH_2)^+{}_{3(aq)} + B_{10}H_{10}^{-2}{}_{(aq)}$$

at room temperature and pressure (e.g., 20° C and 760 mm Hg). The resulting neutral solution is evaporated to dryness (which also removes carbon dioxide) to yield crystalline solid, melting point 273°–280° C. The preparation is essentially stoichiometric. The first crop yield may be further purified by recrystallization. The particle size of the resulting crystals may be controlled by the rate of crystallization.

An alternate preparation of bis-guanidinium decahydrodecaborate (-2) is accomplished by neutralizing an aqueous solution of decahydrodecaboric acid to pH 7.0 with free guanidine base (usually available as a 25% solution in ethanol), and evaporating the resulting neutral solution to dryness. The solution of free guanidine is not particularly stable, however, and the former preparative method is preferred.

The aqueous decahydrodecaboric acid used as a starting material for the process of this invention is conveniently prepared by passing an amine or metal salt of the decahydrodecaborate (-2) ion through a column containing a strongly acidic ion exchange resin of the sulfonic acid type, such as a DUOLITE type C-20, manufactured by the Diamond Shamrock Corporation. Preferred starting salts are bis (triethylammonium) decahydrodecaborate (-2) and disodium decahydrodecaborate (-2). The preparation and properties of the aqueous acid itself are known, and reference may be made to U.S. Pat. No. 3,148,939 for further detail.

The salt described by this invention is useful as a moderate-to-high energy fuel for use in pyrotechnic compounds and rocket and gun propellants. Pyrotechnic compositions and propellants based on the bis-guanidinium decahydrodecaborate salt fill an important gap in the energy output and combustion product stoichemistry available from compositions based on other decahydrodecaboric salts. Such compositions make use of the unique decomposition properties of the decahydrodecaborate (−2) ion, a bicapped square antiprism polyhedral ion with unusual stability; the ion is believed to be kinetically rather than thermodynamically stabilized. The anion demonstrates an unusually fast decomposition upon oxidation, which is believed to proceed through the labile apical hydrogen atoms bonded to the cage. Pyrotechnic compositions based on a physical blend of certain metallic salts of this anion with various inorganic oxidizers have been recognized by ARMSTRONG, U.S. Pat. No. 3,126,305 as providing a wide range of confined burning rates. Physical blends of nonmetallic salts of the decahydrodecaborate ion, including the particular novel salt taught herein are useful to produce extremely fast deflagration rates, and various applications are described in a copending application of common assignment, entitled IGNITION AND PYROTECHNIC COMPOSITIONS, Ser. No. 694,625, filed on even date and in copending application, entitled COPRECIPITATED PYROTECHNIC COMPOSITION PROCESS AND RESULTANT PRODUCTS, Ser. No. 694,626, filed on even date.

Pyrotechnic compositions and propellants, based on the novel compound of this invention exhibit unique behavior. Despite the fact that a high energy fuel is being used, the reaction does not propagate to a detonation, as is true with most commonly used high energy fuels such as commercial and military explosive compositions.

This unusual property is due to the fact that the reaction mechanism is kinetically rather than thermodynamically controlled, i.e., the deflagration occurs in such a manner that much heat is generated in the reaction without said heat accelerating the reaction to the point of detonation. The distinction between deflagration and detonation is used in the common sense, whereby in deflagration, the chemical change or "burning" of the fuel occurs in advance of the compression front caused by the expanding gases. By contrast, in detonation the chemical reaction occurs after the compression or shock wave propagates through the composition medium. A more detailed explanation of this phenomenon may be found in a text on explosives such as C. H. Johansson and P. S. Persson "Detonics of High Explosives," Academic Press, NY., 1970.

The product of this invention, Bis-guanidinium Decahydrodecaborate, and the inventive process for making this new product is illustrated by the following example.

EXAMPLE I 6.9 liters of approximately 0.3 normal decahydrodecaboric acid is neutralized with 197 grams (1.1 moles) guanidine carbonate. The reaction is accompanied by evolution of carbon dioxide gas. The solution is evaporated on a flash evaporator until a slush remains in the rotary flask. The crystals are filtered. A second crop is recovered by evaporating the filtrate to dryness. 249 grams (1.05 moles) of a pure white crystalline powder is recovered after vacuum drying (yield 95%). The dried powder exhibits a moisture content of 0.11%, a melting point of 279° C, a crystal (true) density of 1.11 grams per cubic centimeter, and an average particle size of 46 microns. Calculated boron content of product: 45.4%; found 41.2%.

The infrared spectrum of the compound confirms the identity of the functional groups present in the compound. the $NH_2$ + stretch at 3200–3500 $cm^{-1}$ and N-H bending band at 500 $cm^{-1}$, and the double bonded C=N stretching frequencies at 1,620 and 1,800 $cm^{-1}$ confirm the presence of the quanidium ion. The B-H stretching frequency near 2500 $cm^{-1}$ and the $B_{10}H_{10}^{-2}$ cage modes at 1030, 1070 and 670 $cm^{-1}$ confirm the presence of the decahydrodecaborate (−2) ion.

The utility of the product of this process may be now appreciated by the following example which illustrates an exemplary, though non-limiting, application for the product taught by the present invention.

EXAMPLE II

Hand blended mixes of the bis-guanidinium decahydrodecaborate (-2) from Example I are made with various concentrations of the following inorganic oxidizing agents: potassium nitrate, guanidine nitrate, and ammonium perchlorate. The resulting mixes are ignited in an adiabatic calorimeter, and the heat generated by the resulting deflagration is measured. The results are summarized in Table I, over a range of representative, stable burning concentrations.

TABLE I

| OXIDIZER | RANGE OF CONCENTRATION, %-by-weight, bis-GUANIDINIUM DECAHYDRODECABORATE(-2) | RANGE OF HEAT OF REACTION, CALORIES/GRAM |
|---|---|---|
| Potassium nitrate | 15%–30% | 1250–1375 |
| guanidine nitrate | 8%–30% | 860–990 |
| ammonium perchlorate | 14%–30% | 1890–1780 |

Obvious modifications and equivalents in the present invention will be evident to those skilled in the art, and the scope of the present invention is to be defined solely by the appended claims.

I claim:

1. The bis-guanidinium salt of decahydrodecaboric acid, having the formula $(C(NH_2)_3)_2B_{10}H_{10}$.

* * * * *